US012649501B2

(12) United States Patent
Skowronek et al.

(10) Patent No.: US 12,649,501 B2
(45) Date of Patent: Jun. 9, 2026

(54) COUPLER FOR A RAIL VEHICLE AND RAIL VEHICLE WITH A COUPLER

(71) Applicant: DELLNER COUPLERS AB, Falun (SE)

(72) Inventors: Jacek Skowronek, Gdynia (PL); Martin Holm, Falun (SE); Tomasz Czerwinski, Chwaszczyno (PL)

(73) Assignee: Dellner Couplers AB, Falun (SE)

( * ) Notice: Subject to any disclaimer, the term of this patent is extended or adjusted under 35 U.S.C. 154(b) by 653 days.

(21) Appl. No.: 18/008,890

(22) PCT Filed: Jun. 7, 2021

(86) PCT No.: PCT/EP2021/065189

§ 371 (c)(1),
(2) Date: Dec. 7, 2022

(87) PCT Pub. No.: WO2021/249956

PCT Pub. Date: Dec. 16, 2021

(65) Prior Publication Data

US 2023/0211815 A1 Jul. 6, 2023

(30) Foreign Application Priority Data

Jun. 8, 2020 (EP) ..... 20178784
Dec. 2, 2020 (EP) ..... 20211246
Dec. 2, 2020 (EP) ..... 20211248

(51) Int. Cl.
*B61G 7/08* (2006.01)
*B61G 7/14* (2006.01)

(52) U.S. Cl.
CPC *B61G 7/08* (2013.01); *B61G 7/14* (2013.01)

(58) Field of Classification Search
CPC ... B61G 7/08; B61G 7/14; B61G 7/10; B61G 9/04; B61G 7/12; B61G 9/20; B61G 7/00
See application file for complete search history.

(56) References Cited

U.S. PATENT DOCUMENTS 1,920,410 A * 8/1933 Lorenz ..... B61G 7/14 213/14
2,287,954 A 6/1942 Wolfe
(Continued)

FOREIGN PATENT DOCUMENTS

CH 376956 A 4/1964
CN 110072757 A 7/2019
(Continued)

OTHER PUBLICATIONS

Extended European Search Report in EP Application No. 20211246.2 dated May 11, 2021, 8 pages.
(Continued)

*Primary Examiner* — Cheng Lin
(74) *Attorney, Agent, or Firm* — Howard IP Law Group, PC

(57) ABSTRACT

A coupler for coupling a railway vehicle to another railway vehicle, comprising a mounting arm for mounting the coupler to a railway vehicle, a coupling arm, and a joint, wherein the mounting arm and the coupling arm are connected to each other via the joint in such a way that the mounting arm and the coupling arm are movable relative to each other and the coupling arm can be brought into a position ready for coupling. The coupling further comprises a protective device to prevent or reduce damage to the mounting arm and/or the coupling arm and/or the joint caused by impact forces.

17 Claims, 5 Drawing Sheets

(56) References Cited

U.S. PATENT DOCUMENTS

| | | | | |
|---|---|---|---|---|
| 2,381,603 | A * | 8/1945 | Larsson | B61G 7/12 213/21 |
| 3,871,529 | A * | 3/1975 | Dial | B61G 7/12 213/21 |
| 8,960,464 | B2 * | 2/2015 | Peckham | B61G 7/12 213/9 |
| 9,758,182 | B2 * | 9/2017 | Peckham | B61G 7/12 |
| 10,518,789 | B2 * | 12/2019 | Zhao | B61G 7/08 |
| 2007/0186802 | A1 | 8/2007 | Gough | |
| 2019/0300027 | A1 | 10/2019 | Kolshorn et al. | |
| 2021/0345535 | A1 | 11/2021 | Manica et al. | |
| 2023/0202537 | A1 * | 6/2023 | Czerwinski | B61F 19/04 213/75 R |
| 2023/0211814 | A1 * | 7/2023 | Skowronek | B61G 7/14 213/2 |
| 2023/0211815 | A1 | 7/2023 | Skowronek et al. | |
| 2023/0406371 | A1 | 12/2023 | Kinghorn | |
| 2025/0162623 | A1 | 5/2025 | Gylling | |

FOREIGN PATENT DOCUMENTS

| | | | | |
|---|---|---|---|---|
| CN | 210391159 | U | 4/2020 | |
| CN | 212047325 | U | 12/2020 | |
| DE | 4006811 | A1 * | 9/1991 | B61G 7/10 |
| DE | 19921510 | A1 | 11/2000 | |
| EP | 1112909 | A1 | 7/2001 | |
| JP | H0245263 | A | 2/1990 | |
| WO | 2008132124 | A1 | 11/2008 | |
| WO | 2020140646 | A1 | 7/2020 | |

OTHER PUBLICATIONS

Extended European Search Report in EP Application No. 20211248.8 dated May 10, 2021, 9 pages.

International Search Report and Written Opinion in PCT Application No. PCT/EP2021/065189 mailed on Oct. 1, 2021, 14 pages.

International Search Report and Written Opinion in PCT Application No. PCT/EP2021/065186 mailed on Oct. 1, 2021, 14 pages.

* cited by examiner

COUPLER FOR A RAIL VEHICLE AND RAIL VEHICLE WITH A COUPLER

CROSS-REFERENCE TO RELATED APPLICATIONS

This application is the national stage application under 35 U.S.C. § 371 of International Application No. PCT/EP2021/065189 filed Jun. 7, 2021, which claims priority to EP 2017874.3 filed on Jun. 8, 2020, EP 20211246.2 filed on Dec. 2, 2020, and EP 20211248.8 filed on Dec. 2, 2020, the entire disclosures of which are incorporated herein by reference in their entireties.

FIELD OF INVENTION

The invention pertains to a coupler for a rail vehicle. The invention also pertains to a rail vehicle with a coupler.

SUMMARY

Such Coupler Comprises:

- a front portion having a forward end and a rear end, and a coupler head arranged on the forward end of the front portion;
- a rear portion having a forward end and a rear end and extending along a longitudinal axis from the rear end to the forward end, and
- a pivot anchor arranged on a rear end of the rear portion, the pivot anchor being configured to be attached to a car of a rail vehicle,
- a joint for connecting a rear end of the front portion to the forward end of the rear portion, the joint being configured to allow the front portion to pivot in relation to the rear portion about an pivot axis that is perpendicular to the longitudinal axis from an operational position in which the forward portion and the rear portion are aligned so that the forward portion extends in a forward direction from the rear portion, to a pivoted position in which the forward portion is pivoted about the pivot axis so that the forward portion extends at an angle from the rear portion.

If the coupler is not in use, it is advantageous that the front portion does not protrude from the front of a rail vehicle to save space and to avoid collision with other parts. In order to retract the coupler and to place it in close proximity to the underframe of the rail vehicle, the front portion is pivotable in relation to the rear portion. However, when the coupler is in the retracted position, a damage of the coupler due to accidental collision with mating couplers might occur. If at least one of the mating couplers is not in a position ready for coupling while the coupling process is running, severe damage might occur to the couplers. For example, the forward portion of one coupler rams the joint of the other coupler and damages or destroys it. A reason for the circumstance that a coupler is not in a position ready for coupling while coupling is carried out might be a malfunction of the coupler not allowing a pivoting of the forward portion in relation to the rear portion. Another reason might be that activating such pivoting has been forgotten by the operator.

Therefore, the problem to be solved is to provide a coupler with a pivotable front portion that is better protected for crash scenarios. This problem is solved by the coupler according and the rail vehicle according to embodiments of the present disclosure.

The basic idea of the invention is to provide a protective device which is arranged and designed to prevent or reduce damage to the mounting arm (front portion) and/or the coupling arm (rear portion) and/or the joint caused by impact forces. Such a protective device can be a crash plate arranged on a crash plate holder, wherein the crash plate has a substantially vertical front surface that is arranged in front of the front portion, the rear portion and the joint when the front portion is in the pivoted position and wherein further the crash plate holder is arranged on the pivot anchor or on a part of the coupler that is non-pivotably connected to the pivot anchor. The crash plate protects the coupler—in particular the front portion, rear portion and the joint—from being damaged by a crash caused by a collision with a mating coupler, when the coupler is not in a position ready for coupling.

The crash plate has a substantially vertical front surface. In particular, the surface is preferably even. It is advantageous that the surface is substantially perpendicular to the longitudinal axis of the rear portion. The term "substantially perpendicular" also comprise a deviation from 90° of at most 5°, 10° or 20°. Alternatively, the surface might have a different shape, for example a curved one.

The surface is arranged in front of the front portion (also designated as forward portion), the rear portion and the joint when the front portion is in the pivoted position. In particular, the surface is the part of the coupler protruding at most from the rail vehicle. Therewith, the surface can act as a protective shield avoiding damage to the front portion, rear portion and the joint.

In one embodiment, the crash plate holder is arranged on the pivot anchor. The arrangement might be for example directly, wherein the crash plate holder contacts the pivot anchor. Alternatively, the crash plate holder might be indirectly arranged on the pivot anchor, i.e. between the pivot anchor and the crash plate at least a third part—in particular the rear portion—is arranged. In a preferred embodiment, the crash plate holder is arranged at the forward end of the rear portion. In a conceivable embodiment, it is also possible to arrange the crash plate holder at the forward end of the rear portion and simultaneously directly on the pivot anchor, for example by means of long connection bolts.

Alternatively, the crash plate holder is arranged on a part of the coupler that is non-pivotably connected to the pivot anchor. Preferably, this part of the coupler is the rear portion. The part of the coupler might be non-pivotably connected to the pivot anchor with the opportunity to transform the non-pivotable connection to a pivotable connection, for instance by using a locking pin.

The crash plate is arranged on a crash plate holder. Preferably, the crash plate is connected to the crash plate holder detachably. Alternatively, the connection might be non-detachably.

In a preferred embodiment the rear portion is non-pivotably attached to the pivot anchor. In a preferred embodiment the attachment of the rear portion allows for a first attachment condition, in which the rear portion is non-pivotably attached to the pivot anchor and a second attachment condition, in which the rear portion is pivotably attached to the pivot anchor. This can be provided by a joint and a pin, the joint allowing for the pivotable arrangement and the pin, when inserted into appropriate holes in the parts that would otherwise pivot allowing for a non-pivotable attachment.

In a preferred embodiment the crash plate holder is mounted on the rear portion. Preferably, the crash plate holder is mounted on the forward end of the rear portion. Preferably, the crash plate holder and the rear portion are two different parts. This has the advantage that the crash plate holder might be replaced by a new crash plate holder if it was impaired by a collision with a mating coupler. The same applies to the crash plate which in a preferred embodiment might be replaceable together with the holder. A complete reparation or replacement of the whole coupler is not necessary when the damage is limited to these parts. The crash plate holder and the rear portion might be detachably (e.g. by screws) or permanently (e.g. by welding) connected to each other. In an alternatively embodiment the holder might be a part of the rear portion, preferably forming a single piece with the rear portion.

In a preferred embodiment the crash plate holder is mounted on the joint, preferably on a rear joint portion that is non-pivotably arranged on the rear portion. The crash plate holder can be permanently fixed to the joint. In an alternative embodiment the crash plate holder is releasably fixed to the joint and/or releasably fixed to the rear portion. The crash plate holder can have sliding rails that cooperate with sliding rails on the rear portion that allow the crash plate holder to be slid onto the rear portion.

In a preferred embodiment the crash plate comprises a first plate portion and a second plate portion, each of the first plate portion and second plate portion being arranged vertically facing in the forward direction. Preferably, the first plate portion and the second plate portion are spaced from each other. Preferably, free space is arranged at least partly between the plate portions. This has the advantage that the space between the first and second plate portion can be used to avoid collision between parts of a coupler due to pivoting the portions for example. Furthermore, it saves material.

In a preferred embodiment the first plate portion is arranged in a vertical direction above the second plate portion. Preferably, the first plate portion and the second plate portion might be connected by a third plate portion. The third plate portion might be arranged perpendicular to the other plate portions. In a preferred embodiment the crash plate portions form a U-formed crash plate.

In a preferred embodiment the crash plate has an anti-climbing surface. The anti-climbing surface has the function of preventing mating couplers climbing over each other and continuing movement until colliding with parts of the other vehicle. The anti-climbing surface might be for example a surface with a high static friction and sliding friction. Thereby, a relative sliding of mating crash plates being in contact due to a crash is reduced or inhibited; thus the risk of climbing being reduced. Alternatively or additionally, the anti-climbing properties can be established by a stop element.

In a preferred embodiment at least a part of the crash plate comprises a horizontal alignment device for preventing movement in a horizontal direction of a mating coupler.

In the pivoted position, the forward portion is pivoted about the pivot axis so that the forward portion extends at an angle from the rear portion. In a preferred embodiment the angle is less than 90°. This has the advantage that the forward portion is behind a plane involving the crash plate and do not protrude into the half of a mating coupler. This leads to a better protection of the forward portion and also of the mating coupler since the risk of being damaged by a crash with the forward portion is decreased. In a particular preferred embodiment the angle is less than 45°.

In a preferred embodiment the rear portion and/or the pivot anchor comprises an energy dissipating element that will be destructed, if a force of a certain force level is applied to the energy dissipating element. The energy dissipating element might be a deformation tube. Preferably, the deformation tube is a part of the pivot anchor.

The invention further pertains to a rail vehicle having a coupler according to the invention attached to it.

Moreover, the invention pertains to a coupler for coupling a railway vehicle to another railway vehicle, comprising a mounting arm for mounting the coupler to a railway vehicle, a coupling arm, a joint, wherein the arms are connected to each other via the joint in such a way that the arms are movable relative to each other and the coupling arm can be brought into a position ready for coupling. The coupling further comprises a protective device which is arranged and designed to prevent or reduce damage to the arms and joint caused by impact forces.

The mounting arm is an arm which is intended to be mounted on a railway vehicle. The mounting arm might be connected to the railway vehicle non-pivotably. However, preferably, the mounting arm might be connected to the railway vehicle pivotably, in particular by means of a pivot anchor as described above. The pivotable connection might be locked by means of a locking pin with the result that the pivotable connection is transferred into a non-pivotable connection. Preferably, the mounting arm is connected to the front end or the rear end of the railway vehicle.

The coupling arm is an arm which is intended for realizing the coupling. In particular, for this reason, a coupler head is intended to be fixed on the coupling arm, wherein the coupling is achieved by the engagement of the coupler head with a complementary coupler head of a mating coupler.

Preferably, the mounting arm is the rear portion. Preferably, the coupling arm is the front portion.

The protective device is designed to prevent or reduce damage to the arms and joint caused by impact forces. Any suitable two or three dimensional shape might be conceivable. In preferred embodiment the protective device is a plate. Preferably, the plate is the crash plate. In an advantageous embodiment, the plate is even. Alternatively, it might be curved, for example.

The coupler and in particular the protective device is designed to prevent or reduce damage to the arms and joint caused by impact forces, wherein preferably impact forces are meant which act in the axial direction and/or parallel to the axial direction of the mounting arm. Such impact forces often occur when two complementary couplers are brought together in order to couple rail vehicles.

In a preferred embodiment, the coupling arm is in the coupling position when the arms are coaxial. This is an advantageous position since the current of impact forces during coupling can flow through the arms and can be introduced into the vehicle in a straight line. In comparison to a non-straight line of force flow, the arms and joint are less stressed and less vulnerable for deformations and shifting. In an alternative embodiment, the coupling arm is in the coupling position when the axes of the arms are pivoted at an angle up to 10° to each other.

In a preferred embodiment the coupler and in particular the protective device is designed to prevent or reduce damage to the arms and joint caused by impact forces, when the arms are out of the ready to couple position. This is advantageous since the arms and joint being in this position are in particular vulnerable to damages causing by impact forces of a coupling.

In a preferred embodiment the protective device is attached to the mounting (and/or coupling) arm, preferably at the end of the mounting (and/or coupling) arm. Preferably, the protective device is attached indirectly to the mounting (and/or coupling) arm by a holder. Preferably, the protective device is detachably or non-detachably mounted on the holder. Preferably, the holder is the crash plate holder. Alternatively or additionally, the protective device is attached to the joint.

In a preferred embodiment the coupling arm comprises a coupler head. Preferably, the coupler head is arranged on the end of the coupling arm. The coupler head is intended being engaged with a complementary coupler head in order to establish the coupling of the vehicles.

In a preferred embodiment the joint connects the end of the coupling arm with the end of the mounting arm. Therein, the coupling head is preferably mounted on the opposite end of the coupling arm.

In a preferred embodiment the opposite end of the mounting arm is intended for attachment to the railway vehicle. The mounting arm might be connected to the railway vehicle by means of the pivot anchor.

In a preferred embodiment the joint is a swivel joint. In particular, it comprises a pivot axis which is preferably substantially perpendicular to the longitudinal axis of the mounting arm and/or to the longitudinal axis of the coupling arm. In particular, the joint allows the coupler arm to swivel in relation to the mounting arm in a plane being perpendicular to the pivot axis.

In a preferred embodiment the mounting arm and/or the coupling arm comprises an energy dissipating device or mechanism, wherein the energy absorbing device is preferably a deformation tube.

The invention also refers to rail vehicle having a coupler according to the invention. In a preferred embodiment, the coupler is configured to prevent or reduce damage to the joint and arms if the impact forces are caused by a complementary coupler of the other rail vehicle. In particular, the complementary coupler is a coupler according to the invention. Preferably, the complementary coupler is out of the coupling ready position when the impact forces are caused by the complementary coupler. In such a way, the accordingly protective devices crash against each other without causing damage to the parts of the couplers. In a preferred embodiment the protective device of the coupling and the protective device of the complementary coupling have a surface contact at impact time.

BRIEF DESCRIPTION OF DRAWINGS

Hereinafter, the invention is explained with reference to FIGS. 1 to 5 which only shows exemplary embodiments of the invention.

DETAILED DESCRIPTION

Figure 1:
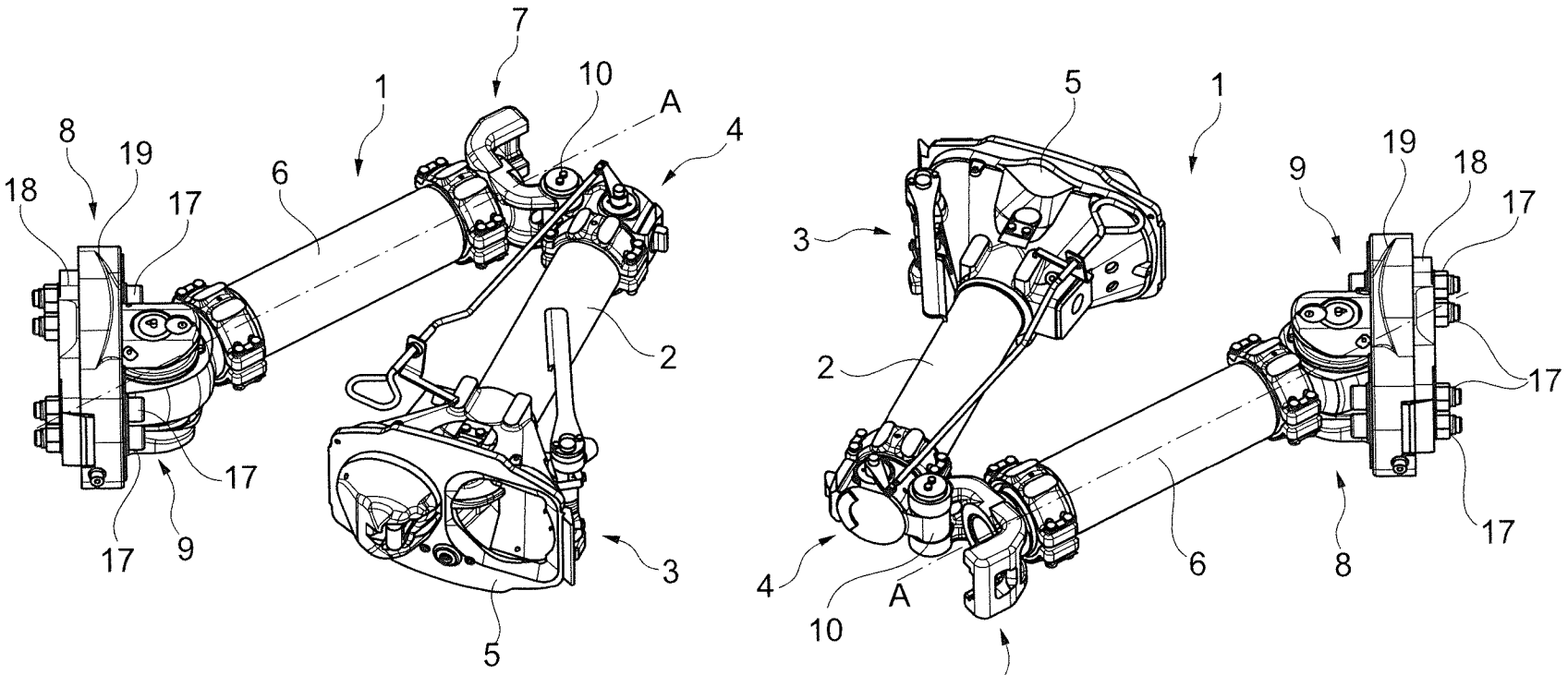
FIG. 1 shows a schematic perspective view of a first coupler according to the prior art arranged next to a second coupler according to the prior art.

FIG. 1 shows a schematic perspective view of a first coupler 1 according to the prior art arranged next to a second coupler 1 according to the prior art. The couplers 1 are for a rail vehicle. The first coupler 1 will be attached to an end of one rail vehicle. The second coupler 1 will be attached to an end of a further rail vehicle that is arranged neighboring the one car. The couplers 1 each comprise

- a front portion 2 having a forward end 3 and a rear end 4, and a coupler head 5 arranged on the forward end 3 of the front portion 2;
- a rear portion 6 having a forward end 7 and a rear end 8 and extending along a longitudinal axis A from the rear end 8 to the forward end 7, and
- a pivot anchor 9 arranged on a rear end 8 of the rear portion 6, the pivot anchor 9 being configured to be attached to a car of a rail vehicle,
- a joint 10 for connecting a rear end 4 of the front portion 2 to the forward end 7 of the rear portion 6, the joint 10 being configured to allow the front portion 2 to pivot in relation to the rear portion 6 about an pivot axis B that is perpendicular to the longitudinal axis A from an operational position in which the forward portion 2 and the rear portion 6 are aligned so that the forward portion 2 extends in a forward direction from the rear portion 6, to a pivoted position in which the forward portion 2 is pivoted about the pivot axis B so that the forward portion 2 extends at an angle from the rear portion 6.

Figure 2:
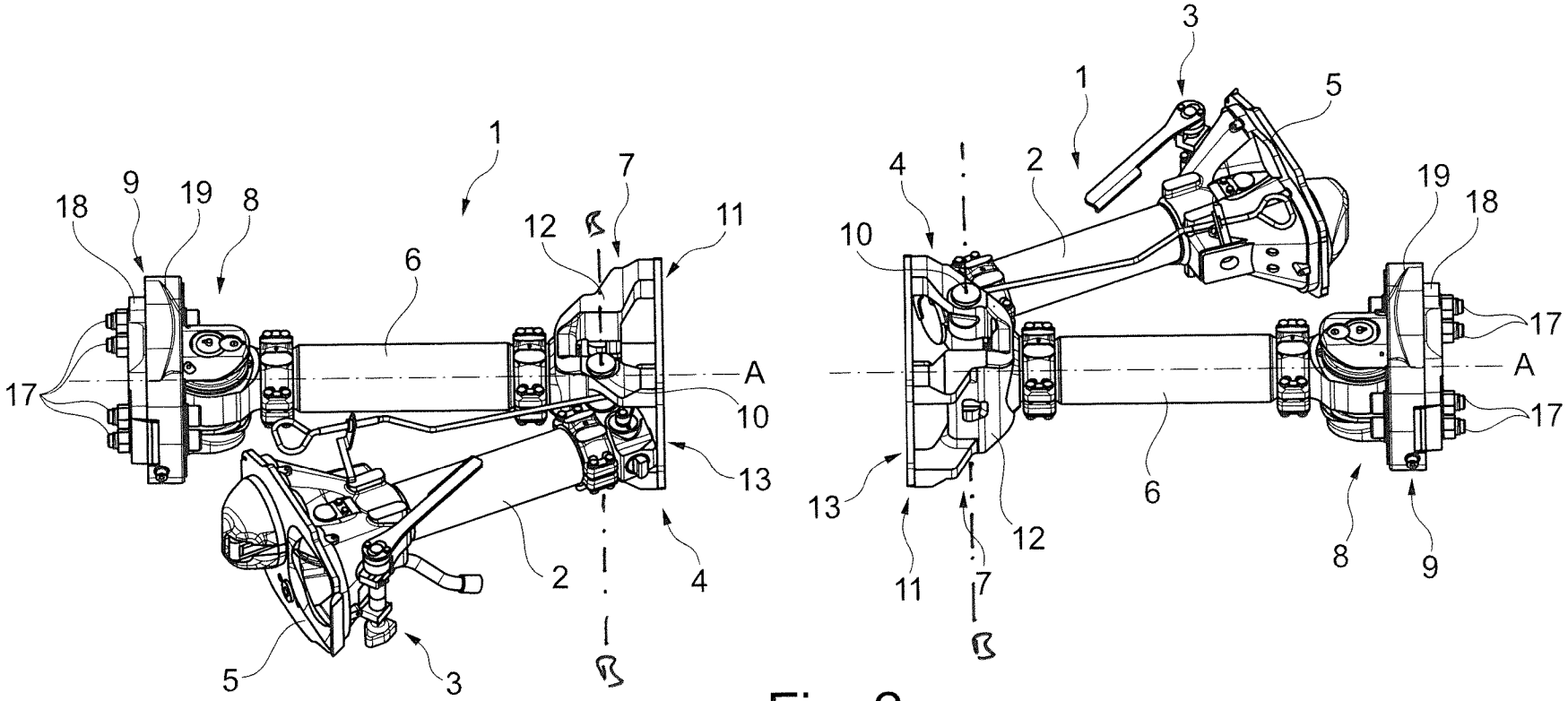
FIG. 2 shows a schematic perspective view of a first coupler according to the invention arranged next to a second coupler according to the invention in a first operational state.
Figure 3:
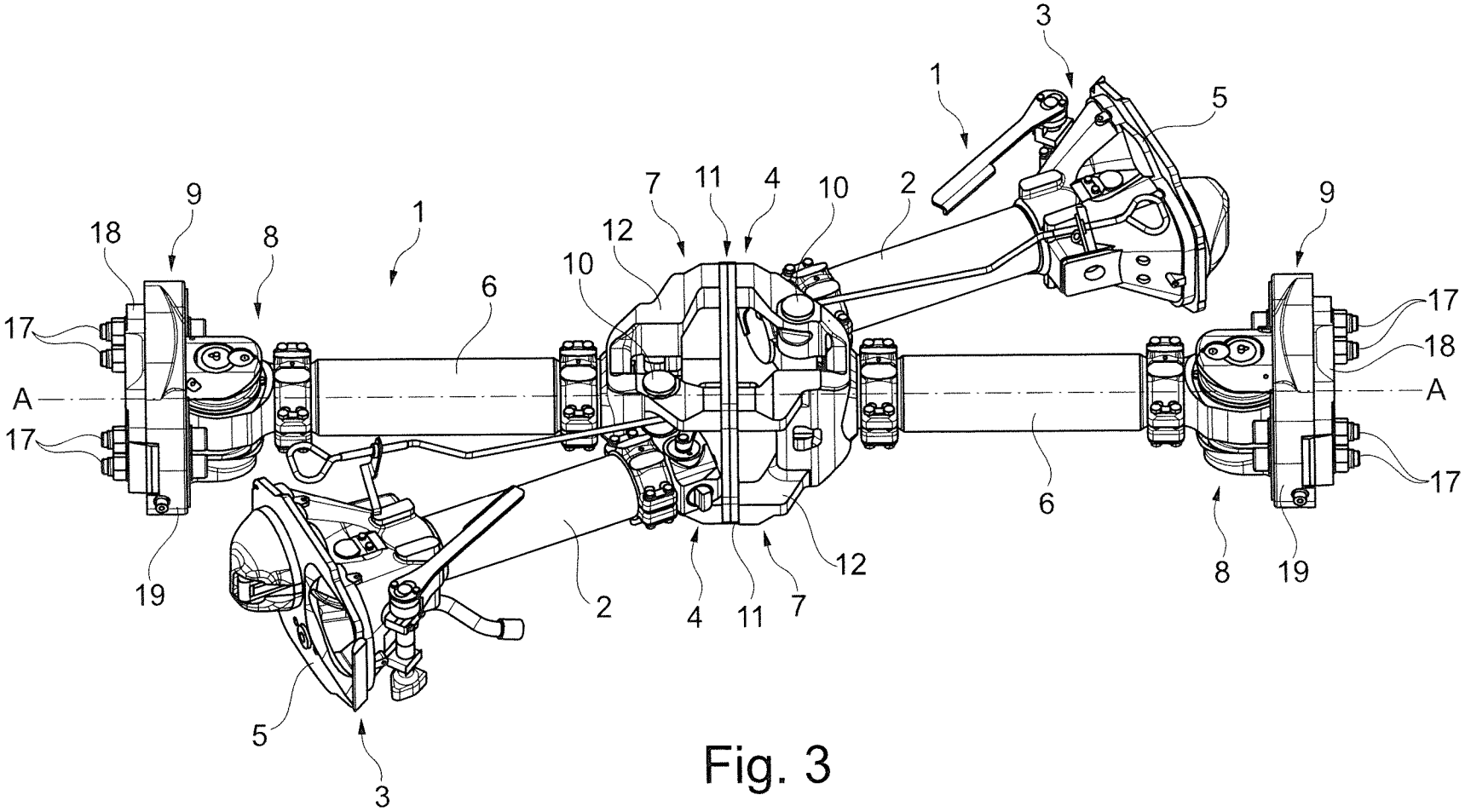
FIG. 3 shows a schematic perspective view of a first coupler according to the invention arranged next to a second coupler according to the invention in a second operational state.
Figure 4:
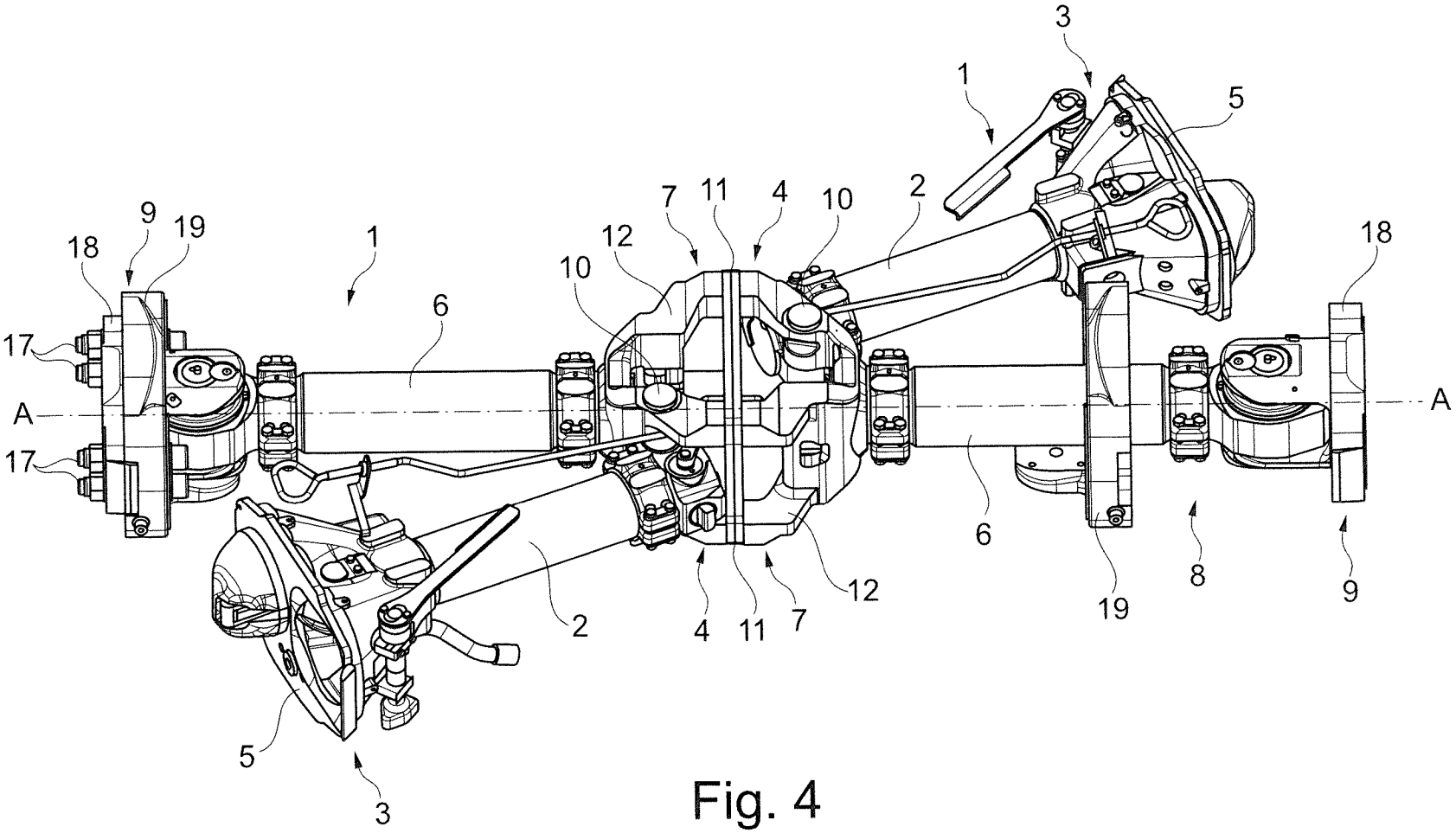
FIG. 4 shows a schematic perspective view of a first coupler according to the invention next to a second coupler according to the invention in a third operational state and FIG. 5 shows a schematic perspective view of a crash plate holder of a coupler according to the invention.
Figure 5:
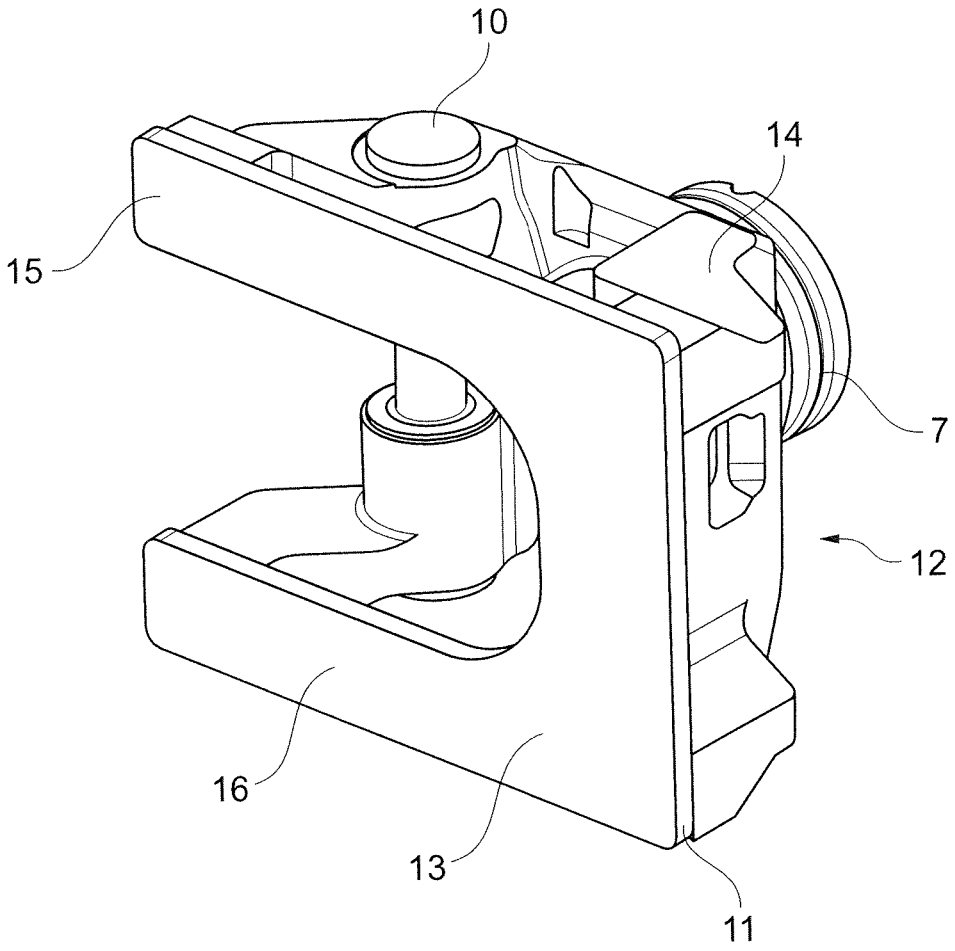

FIGS. 2 to 4 show a schematic perspective view of a first coupler according to the invention arranged next to a second coupler according to the invention. The couplers 1 are for a rail vehicle. The first coupler 1 will be attached to an end of a rail vehicle. The second coupler 1 will be attached to an end of a further rail vehicle that is arranged neighboring the one car.

The Couplers 1 Each Comprise

- a front portion 2 having a forward end 3 and a rear end 4, and a coupler head 5 arranged on the forward end 3 of the front portion 2;
- a rear portion 6 having a forward end 7 and a rear end 8 and extending along a longitudinal axis A from the rear end 8 to the forward end 7, and
- a pivot anchor 9 arranged on a rear end 8 of the rear portion 6, the pivot anchor 9 being configured to be attached to a car of a rail vehicle,
- a joint 10 for connecting a rear end 4 of the front portion 2 to the forward end 7 of the rear portion 6, the joint 10 being configured to allow the front portion 2 to pivot in relation to the rear portion 6 about an pivot axis B that is perpendicular to the longitudinal axis A from an operational position in which the forward portion 2 and the rear portion 6 are aligned so that the forward portion 2 extends in a forward direction from the rear portion 6 (not shown in the FIGS. 2 to 4), to a pivoted position in which the forward portion 2 is pivoted about the pivot axis B so that the forward portion 2 extends at an angle from the rear portion 6 (see FIGS. 2 to 4).

The couplers 1 according to the invention further each comprise a crash plate 11 arranged on a crash plate holder 12, said crash plate 11 having a substantially vertical front surface 13 that is arranged in front of the front portion 2, the rear portion 6 and the joint 10 when the front portion 2 is in the pivoted position.

In the couplers 1 according to the invention the crash plate holder 12 is arranged on the pivot anchor 9 or on a part of the coupler 1 that is non-pivotably connected to the pivot anchor 9.

The rear portion 6 is non-pivotably attached to the pivot anchor 9. The crash plate holder 12 is mounted on the rear portion 6. The crash plate holder 12 is mounted on the joint 10, namely on a rear joint portion 14 that is non-pivotably arranged on the rear portion 6. The crash plate 11 comprises a first plate portion 15 and a second plate portion 16, each of the first plate portion 15 and second plate portion 16 being arranged vertically facing in the forward direction. The first plate portion 15 is arranged in a vertical direction above the second plate portion 16. The crash plate 11 has an anti-climbing surface. At least a part of the crash plate 11 comprises a horizontal alignment device for preventing movement in a horizontal direction of a mating coupler. The angle is less than 90°, preferably less than 45°.

The pivot anchor 9 comprises an energy dissipating elements in form of shear out bolts 17. The shear out bolt 17 connects a plate 18 of the pivot anchor 9 with a frame plate 19. The frame plate 19 is intended for being connected to the underframe of a car of a rail vehicle. The shear out bolts 17 will be destructed, if a force of a certain force level is applied to them. Destruction of the shear out bolts 17 also destroys the connection between the plate 18 and the frame plate 19 and sets the frame plate 19 free to move relative to the plate 18. This status is shown in FIG. 4 on the right hand coupler 1.

FIG. 2 shows the couplers 1 in a first operational state. This could be the state, where a rail vehicle with the first coupler attached to it is parked next to a further rail vehicle with the second coupler attached to it.

FIG. 3 shows the couplers 1 in a second operational state. This could be the state, where a rail vehicle with the first coupler attached to it has travelled in the direction of the further rail vehicle with the second coupler attached to it and crashes into the further rail vehicle.

FIG. 4 shows the couplers 1 in a second operational state. This could be the state, where a rail vehicle with the first coupler attached to it has travelled in the direction of the further rail vehicle with the second coupler attached to it and has crashed into the further rail vehicle with such force that the shear out bolts 17 have sheared out (they are not shown on the right hand coupler in FIG. 4 any further) and have set the frame plate 19 free in relation to the plate 18. The plate 18 will move under/into the underframe of the rail vehicle, while the frame plate 19 stay connected to the underframe of the rail vehicle by bolts that are not shown in FIGS. 1 to 4.

The invention claimed is:

1. A coupler for coupling a railway vehicle to another railway vehicle, comprising:

a mounting arm for mounting the coupler to a railway vehicle, wherein the mounting arm comprises a rear portion having a forward end and a rear end and extending along a longitudinal axis (A) from the rear end to the forward end;

a coupling arm comprising a front portion having a forward end and a rear end, and a coupler head arranged on the forward end of the front portion; and a joint;

wherein the mounting arm and the coupling arm are connected to each other via the joint in such a way that the mounting arm and the coupling arm are movable relative to each other and the coupling arm can be brought into a position ready for coupling; and wherein the coupler further comprises a protective device comprising a crash plate arranged on a crash plate holder, wherein the crash plate holder is arranged on a pivot anchor configured to be attached to a car of a railway vehicle, or on a part of the coupler that is non-pivotably connected to the pivot anchor to prevent or reduce damage to the mounting arm and/or the coupling arm and/or the joint caused by impact forces.

2. The coupler of claim 1, wherein the angle is less than 45°.

3. The coupler of claim 1, wherein the crash plate holder is mounted on the rear portion.

4. The coupler of claim 1, wherein the crash plate comprises a first plate portion and a second plate portion, each of the first plate portion and second plate portion being arranged vertically facing in a forward direction, wherein the first plate portion is arranged in a vertical direction above the second plate portion.

5. A coupler for coupling a railway vehicle to another railway vehicle, comprising:

a mounting arm for mounting the coupler to a railway vehicle;

a coupling arm comprising a front portion having a forward end and a rear end, and a coupler head arranged on the forward end of the front portion;

a joint;

wherein the mounting arm comprises a rear portion having a forward end and a rear end and extending along a longitudinal axis (A) from the rear end to the forward end;

wherein the mounting arm and the coupling arm are connected to each other via the joint in such a way that the mounting arm and the coupling arm are movable relative to each other and the coupling arm can be brought into a position ready for coupling;

a pivot anchor arranged on a rear end of the rear portion, the pivot anchor configured to be attached to a car of a rail vehicle;

wherein the joint connects the rear end of the front portion to the forward end of the rear portion, the joint configured to allow the front portion to pivot in relation to the rear portion about a pivot axis (B) that is perpendicular to the longitudinal axis (A) from an operational position in which the forward portion and the rear portion are aligned so that the forward portion extends in a forward direction from the rear portion, to the pivoted position in which the forward portion is pivoted about the pivot axis (B) so that the forward portion extends at an angle from the rear portion;

and wherein:

the coupler further comprises a crash plate arranged on a crash plate holder, said crash plate having a substantially vertical front surface that is arranged in front of the front portion, the rear portion and the joint when the front portion is in the pivoted position; and the crash plate holder is arranged on the pivot anchor or on a part of the coupler that is non-pivotably connected to the pivot anchor.

6. The coupler of claim 5, wherein the rear portion is non-pivotably attached to the pivot anchor.

7. The coupler of claim 5, wherein the crash plate holder is mounted on the rear portion.

8. The coupler of claim 5, wherein the crash plate holder is mounted on a rear joint portion of the joint, the rear joint portion being non-pivotably arranged on the rear portion.

9. The coupler of claim 5, wherein the crash plate comprises a first plate portion and a second plate portion, each of the first plate portion and second plate portion being arranged vertically facing in the forward direction.

10. The coupler of claim 9, wherein the first plate portion is arranged in a vertical direction above the second plate portion.

11. The coupler of claim 5, wherein the crash plate has an anti-climbing surface.

12. The coupler of claim 5, wherein at least a part of the crash plate comprises a horizontal alignment device for preventing movement in a horizontal direction of a mating coupler.

13. The coupler of claim 5, wherein the angle is less than 90°.

14. The coupler of claim 13, wherein the angle is less than 45°.

15. The coupler of claim 5, wherein the rear portion and/or the pivot anchor comprises an energy dissipating element that will be destructed when a force of a certain force level is applied to the energy dissipating element.

16. A rail vehicle with a coupler comprising:

a car body;

a coupler connected to the car body;

wherein the coupler comprises:

a mounting arm for mounting the coupler to the railway vehicle;

a coupling arm; and wherein the coupling arm comprises a front portion having a forward end and a rear end, and a coupler head arranged on the forward end of the front portion;

wherein the mounting arm comprises a rear portion having a forward end and a rear end and extending along a longitudinal axis (A) from the rear end to the forward end;

a pivot anchor arranged on the rear end of the rear portion, the pivot anchor configured to be attached to the car body of the rail vehicle;

a joint for connecting the rear end of the front portion of the coupling arm to the forward end of the rear portion of the mounting arm, the joint configured to allow the front portion to pivot in relation to the rear portion about a pivot axis (B) that is perpendicular to the longitudinal axis (A) from an operational position in which the forward portion and the rear portion are aligned so that the forward portion extends in a forward direction from the rear portion, to a pivoted position in which the forward portion is pivoted about the pivot axis (B) so that the forward portion extends at an angle from the rear portion;

and wherein:

the coupler further comprises a crash plate arranged on a crash plate holder, said crash plate having a substantially vertical front surface that is arranged in front of the front portion, the rear portion and the joint when the front portion is in the pivoted position; and the crash plate holder is arranged on the pivot anchor or on a part of the coupler that is non-pivotably connected to the pivot anchor.

17. The rail vehicle of claim 16, wherein the pivot anchor comprises an energy dissipating element comprising shear out bolts that connect a first plate of the pivot anchor with a frame plate for connection to the car body underframe; and wherein application of a force of a certain force level to the shear out bolts destroys the connection between the first plate and the frame plate to thereby enable the frame plate to move relative to the first plate.

* * * * *